US006115993A

United States Patent [19]

O'Donnell

[11] Patent Number: 6,115,993

[45] Date of Patent: Sep. 12, 2000

[54] TAG PRESENTER

[75] Inventor: Colin M. O'Donnell, Worthington, Minn.

[73] Assignee: Bedford Industries, Inc., Worthington, Minn.

[21] Appl. No.: 09/169,153

[22] Filed: Oct. 9, 1998

Related U.S. Application Data

[60] Provisional application No. 60/061,510, Oct. 10, 1997.

[51] Int. Cl.[7] ..... B65B 41/16

[52] U.S. Cl. ..... 53/389.4; 53/135.1; 53/136.1; 53/138.3; 53/138.7; 53/138.8

[58] Field of Search ..... 53/135.1, 136.1, 53/136.5, 138.3, 138.4, 138.6, 138.7, 138.8, 139.1, 389.4

[56] References Cited

U.S. PATENT DOCUMENTS

| | | |
|---|---|---|
| 3,131,520 | 5/1964 | Wilson et al. . |
| 3,163,969 | 1/1965 | Irwin et al. . |
| 3,283,474 | 11/1966 | Bower . |
| 3,375,634 | 4/1968 | Järund . |
| 3,386,478 | 6/1968 | Pitkanen . |
| 3,741,451 | 6/1973 | Parenti et al. . |
| 3,792,807 | 2/1974 | Mare et al. . |
| 4,284,221 | 8/1981 | Nagel et al. . |
| 4,375,189 | 3/1983 | Berner et al. . |
| 4,660,351 | 4/1987 | Saitoh . |
| 4,688,708 | 8/1987 | Irvine et al. . |
| 4,711,064 | 12/1987 | Tsuda . |
| 4,997,119 | 3/1991 | Meschi . |
| 5,067,313 | 11/1991 | Evans . |
| 5,100,040 | 3/1992 | Kunreuther et al. . |
| 5,141,142 | 8/1992 | Ramsey . |
| 5,540,369 | 7/1996 | Boreali et al. . |
| 5,573,621 | 11/1996 | Boreali . |
| 5,771,664 | 6/1998 | Recchia . |

*Primary Examiner*—Daniel B. Moon
*Attorney, Agent, or Firm*—R. C. Baker & Associates, Ltd.

[57] ABSTRACT

The apparatus for intermittently presenting tags for attachment to merchandise has a pay-out tape of tags severable by lines of weakness, drive rollers for intermittently advancing tape from the pay-out roll, breaking rollers that rotate at a greater speed than said drive rollers so as to sever a single tag from the tape at a line of weakness, and holding guide members on opposing sides of a severed single tag for presenting a portion of the tag for attachment to merchandise by a twist tie while temporarily holding the remaining portion between the opposing guide members. A key step of the method is that of presenting a portion of a marking tag in a projecting relationship from the exit of an opposing pair of holding guide members while maintaining the bulk of the marking tag within the opposing holding guide members in a manner permitting easy withdrawal of it, and attaching the projecting portion to the neck of a bag by a twist tie.

11 Claims, 5 Drawing Sheets

TAG PRESENTER

CROSS-REFERENCE TO RELATED APPLICATIONS

This application claims the priority benefit of provisional application Ser. No. 60/061,510, filed Oct. 10, 1997.

BACKGROUND OF THE INVENTION

This invention relates to apparatus and a method for attaching tags to merchandise and especially to an apparatus and method for presenting tags in a manner for affixation to merchandise. More particularly, the invention relates to presenting tags intermittently for twist tie ribbon attachment to merchandise; and in its ideal application, the invention relates to an apparatus and method effecting the combined presentation and twist tie affixation (attachment) of tags to merchandise.

Insofar as is known, the affixation of marking tags by means of a twist tie to merchandise, without the marking tag being a part of the twist tie ribbon structure, has not heretofore been successfully practiced to any significant commercial extent. The difficulty lies in presenting a marking tag in an intermittent manner and in a position suitable for intermittent machine application of a twist tie ribbon about not only the tag but also the neck of a bag or the like. Interference with twist tie machine operation must be avoided, and yet the tag, if it is to be held to a bag by twist tie ribbon, must be presented in a position to be embraced by the twist tie ribbon as the twist tie ribbon is placed around the neck of the bag. Additionally, however, the reliability of the tag as a marker requires avoidance of mutilation, especially mutilation of any part of the tag dealing with or carrying a machine readable or scannable code, as is so often required nowadays in view of the intense marketplace competition and the need for economy in all handling steps in the channels of marketing. To the extent known, no one has heretofore solved the several aforementioned problems with the mechanical simplicity and uniqueness offered by the teachings of this invention.

SUMMARY OF THE INVENTION

The invention provides an apparatus and method for presenting tags in a posture or manner for attachment to merchandise, especially merchandise moving along a conveyor line. The apparatus comprises a payout tape roll of tags united to each other by lines of weakness (e.g., perforations) extending laterally at intermittent spacing along the length of the tape of the roll. Drive rollers are intermittently activated to advance the tape in response to sensing or other recognition when a previously advanced tag of the tape has been attached to merchandise. At the same time drive rollers are activated to advance tape from the payout roll, breaking rollers are also activated to rotate at a speed greater than the activated drive rollers. This causes the tape between the breaking rollers to be pulled faster than the tape between the drive rollers, to thereby sever a single tag from the advancing end of the tape of tags at a line of weakness in the tape. Guide members on opposite sides of the severed tag present it at an exit between the guide members. A portion of the tag extends out from the exit formed by the opposing guide members and, in the most preferred embodiment, this extension of the tag is in a position within the throat of a twist tie applicator machine.

An interesting aspect of the method is that of presenting or holding a discrete tag in a projecting relationship from the exit of opposing guide members while maintaining the bulk of the marking tag between the opposing guide members in a manner permitting immediate withdrawal of the bulk from the opposing guide members after the projecting portion has been affixed by a twist tie to merchandise.

Additional details, benefits and advantages of the invention will further be described herein below.

DETAILED DESCRIPTION OF THE PREFERRED EMBODIMENT

Figure 1:
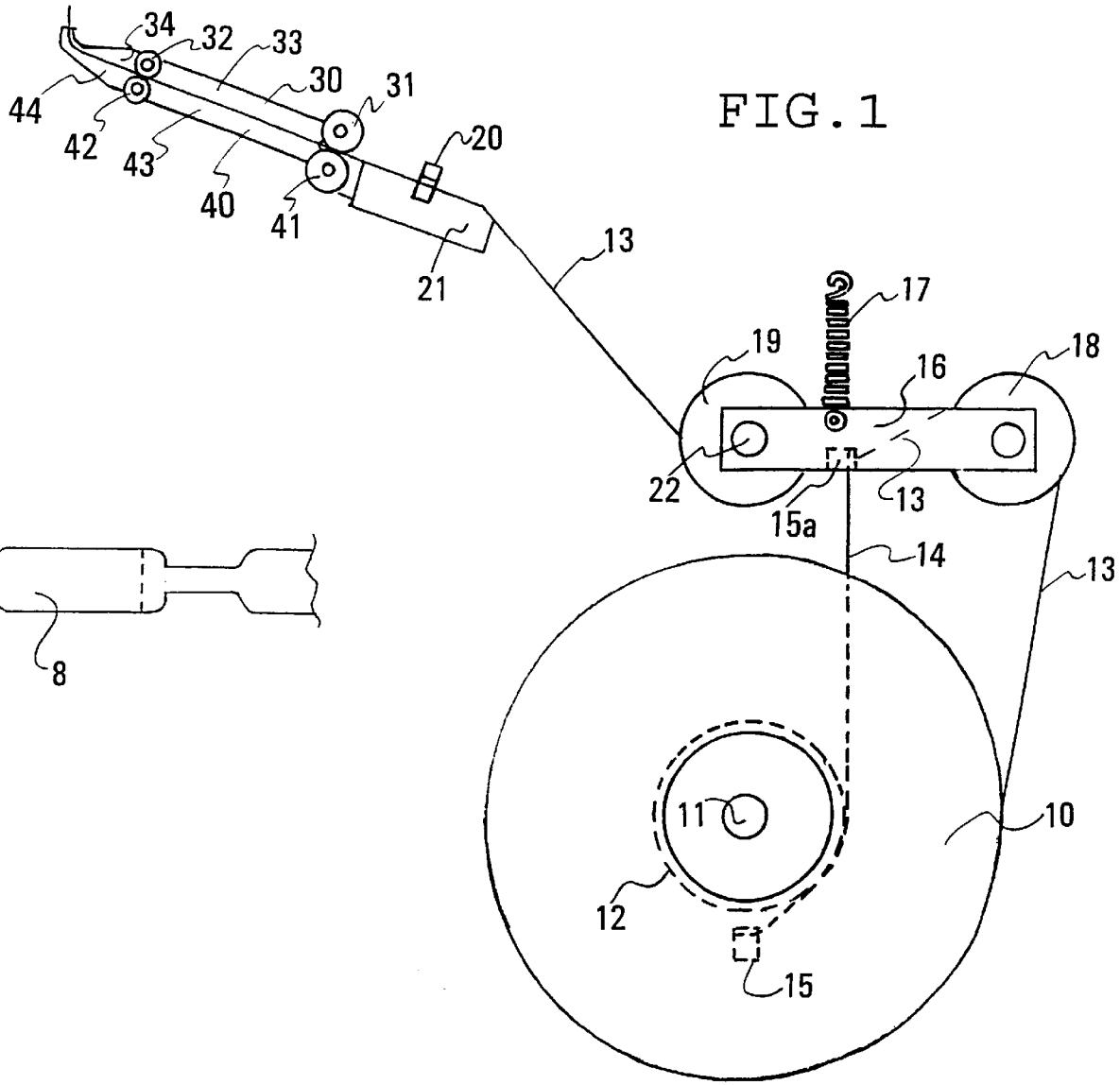
FIG. 1 is a schematic side view (partially sectional) of the tape presenter apparatus of the invention, with frame and foundational elements omitted.

Referring to FIG. 1, a payout tape roll of tags 10 is suitably mounted on a reel and serves as a source or "magazine" for a length of the tags in tape or strip form 13. The reel of this payout roll is mounted on a shaft 11, and the reel has a hub member 12 against which a strap 14 of brake material (such as neoprene rubber or the like suitably reinforced with fabric) is externally engaged for braking purposes. The strap 14 extends between one end 15 of it fixed to a base mount on a frame (not shown), and the other end 15*a* of it fixed to a dancer arm 16. Pulling of a length of the tag strip or tape 13 from the payout roll 10 about the upper edge of tension pulley 18 and the lower edge of tension pulley 19 causes the dancer arm 16 to pivot downwardly (or clockwise as viewed) about shaft 22 on which the tension roll 19 (also called tension pulley 19) is mounted. This in turn releases the brake strap 14 for so long as the dancer arm 16 is drawn downwardly toward the payout roll 10, but spring 17 causes the dancer arm 16 to return to a condition causing braking of the rotation of the payout roll 10 when a single feed cycle for a tag is completed.

Figure 1A:
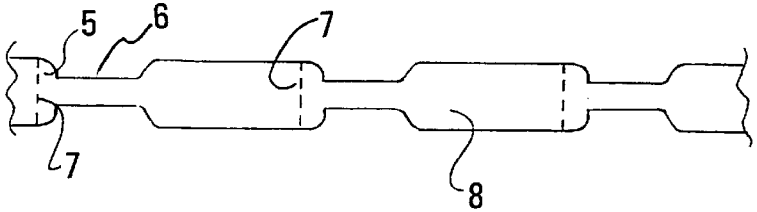
FIG. 1A is a schematic top plane view of a length of tape of tags separated by lines of weakness; this view illustrates two full tags and a fragment of tags at opposite ends of the length.

A tape 13 of tags on the payout roll may illustratively comprise tags having somewhat the shape of a dumbbell (although flat). As illustrated in FIG. 1A, a lead lateral enlargement 5 is immediately after and adjacent a line of weakness or perforation 7. A neck 6 of relatively small lateral extent is below the enlarged upper or lead portion 5. Then there is a relatively greater length of wide tag body 8, and this constitutes the area where ideally there is appropriate marking and printing and other labeling, including any scanning codes.

Figure 2:
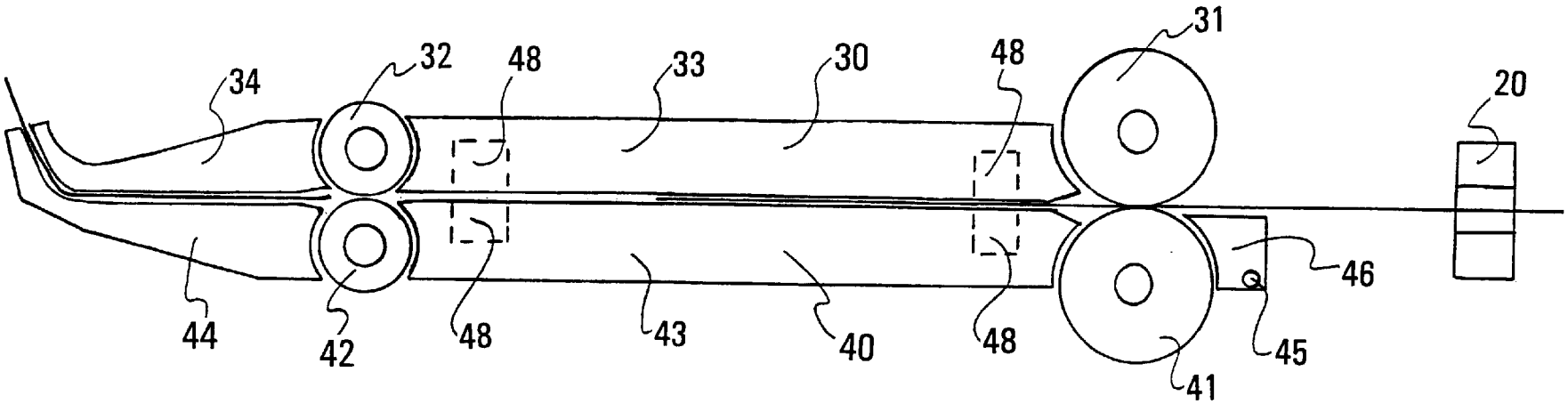
FIG. 2 is an enlarged schematic sectional view of the tag presenting apparatus at the end thereof where the opposing guide members called jaws are located and a sensor is located.

Refer now to FIGS. 1 and 2 for a description of what happens at the end of the tag presenter apparatus opposite the payout roll end. First, after leaving the payout end (and pulley 19), the tape 13 of severable tags passes over a plate 21 on which a sensor 20 is located. The tape passes through a gap of the sensor 20, then between drive rollers 31 and 41 into a channel between guide members 33 and 43. Then the tape passes between the breaking or severing rollers 32 and 42 into a channel between the presenter guide members (e.g., plates) 34 and 44. The presenter guides suitably are curved or contoured as illustrated.

Note that this end of the tape presenting apparatus (opposite the payout end) has opposing guide members suitably called jaws 30 and 40. Illustratively, jaw 40 comprises the lower elements of the apparatus and those are recited as curved nozzle presenter guide 44, the lower breaking (i.e., severing) roller 42, the lower guide plate 43, the lower drive roller 41, and a guide member 46 upstream from and adjacent to drive roller 41. All of these are mounted in a frame so as to be unified together for pivot about a pivot shaft 45 so as to permit pivot opening of the entire lower jaw (downwardly from the upper jaw) for appropriate positioning of the tape of tags between the jaws. Closure of the lower jaw against the upper jaw is secured suitably by strap members 48. Two straps 48 on each lateral side of the main guide plates 33 and 43 between the drive and breaking or severing rollers are useful.

Figure 4:
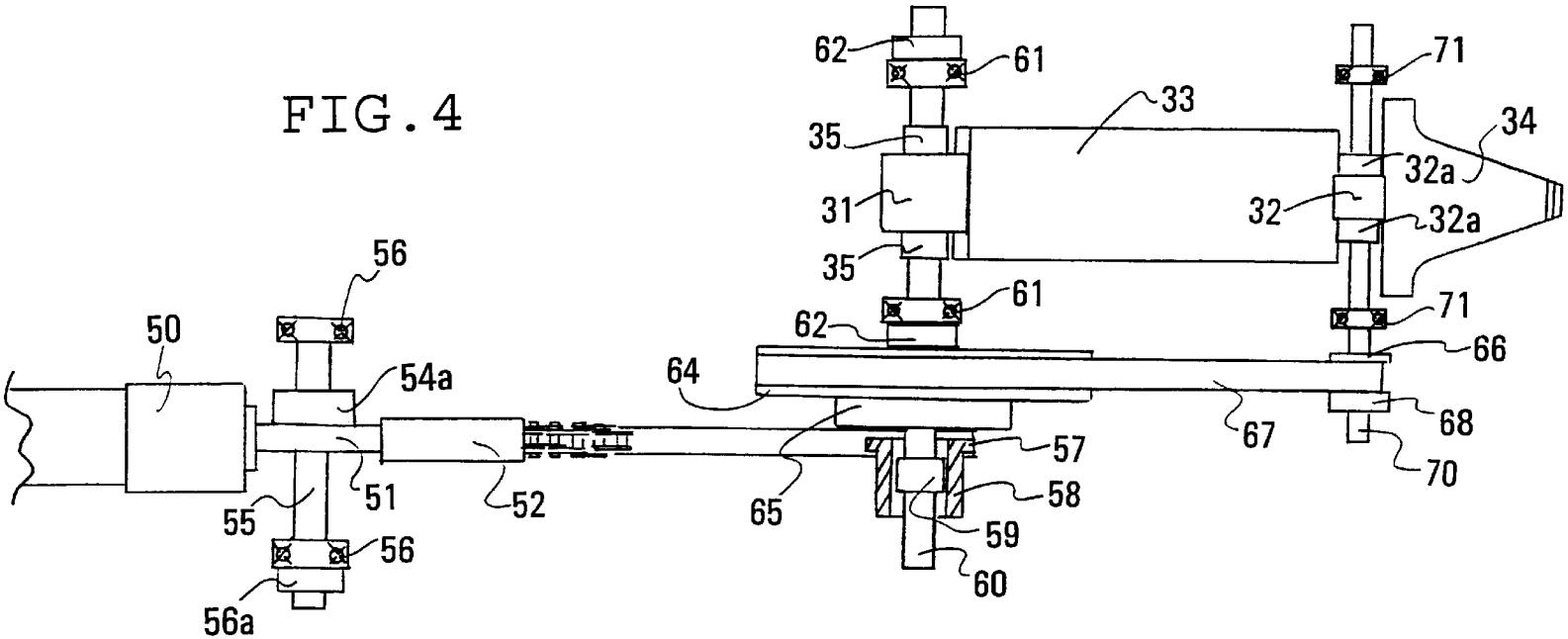
FIG. 4 is a schematic top plane view of the same elements as illustrated in FIG. 3, with added detail in the illustration.
Figure 3:
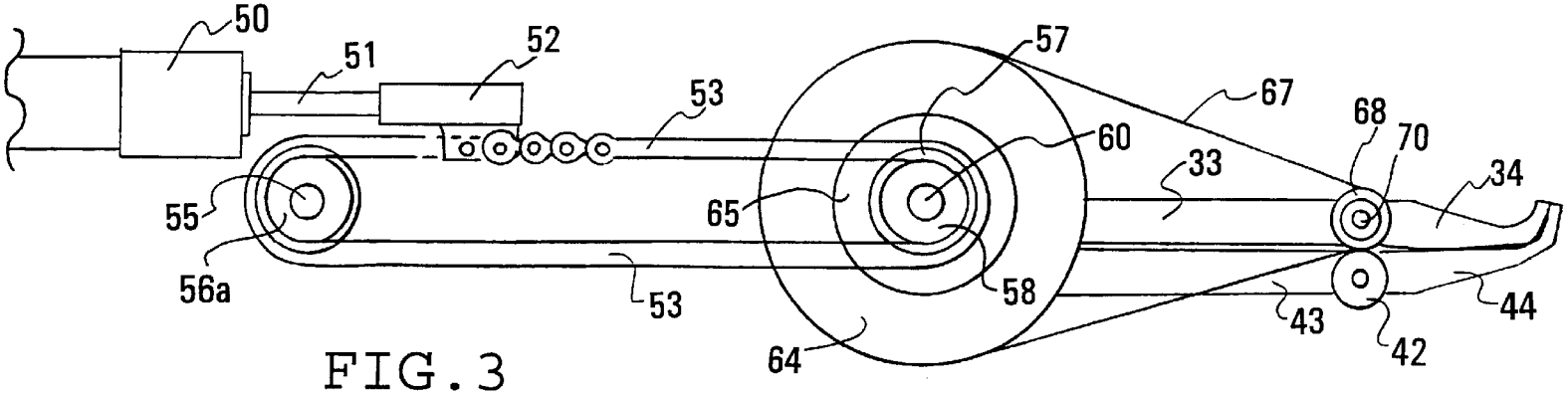
FIG. 3 is a schematic side view of the portion of the tag presenter apparatus consisting of the opposing jaws and the activating mechanism for intermittently rotating the drive and the break rollers.

FIGS. 3 and 4 will now be explained, and attention is first called to the nozzle or exit end of the tag presenter as formed by the curved plates 34 and 44. An air cylinder 50 operates a piston rod 51 that is mounted through a bracket 52 in a fixed manner on a chain 53. The chain can be similar to a bicycle chain, but others of suitable nature may also be employed. If desired, a power activator arrangement other than an air cylinder and piston shaft may be employed.

A sprocket is mounted via its sprocket hub 54*a* on shaft 55 between a set of bearings 56 held in position on the shaft 55 by one or more locking collars 56*a*. (The sprocket and its hub 54*a* are behind the locking collar 56*a* in FIG. 3 and, while the sprocket hub 54*a* is shown in FIG. 4, the sprocket itself is behind piston rod 51 in FIG. 4.) After the chain is entrained about the sprocket of sprocket hub 54*a,* it is entrained about further or forward sprocket 57 carrying a laterally extending hub 58 that encompasses a one-way roller clutch on the drive shaft 60. The roller clutch 59 prevents backward (clockwise) rotation of the sprocket 57 of FIG. 3 when the air cylinder 50 extends the piston rod 51 (toward the right in FIGS. 3 & 4) in preparation for a new cycle of intermittent operation to present a tag. When the piston rod 51 is retracted (to the left in FIGS. 3 & 4), the clutch 59 engages to rotate sprocket 57 and shaft 60 in a counterclockwise direction as viewed in FIG. 3, which causes drive roller 31 (and its contacting drive roller 41) to advance the tape of marking tags.

Drive roller 31 of the upper jaw (see FIG. 4) is rigidly fixed by lateral hub members 35 to shaft 60 for rotation with it. Bearings 61 permit rotation of the shaft 60 with minimal friction, and collars 62 are fixed to shaft 60 to prevent longitudinal shift of the elements about the shaft.

A master pulley 64 (e.g., suitably toothed as, for example, a pulley of the timing pulley type) carries a hub 65, which is used to fix it rigidly to shaft 60. This master pulley 64 provides the motive force for greater rotation of the breaking or severing pulleys 32 and 42 than the rotation of the driving pulleys 31 and 41 when the piston rod 51 effects movement of chain 53 (to the left in FIGS. 3 and 4) and therefore counterclockwise rotation of the drive pulley 31 (as viewed in FIG. 3) Drive pulley 41 (see FIGS. 1 and 2) below drive pulley 31 is suitably rotated by the frictional contact of drive pulley 31 on it. The line of contact between the driving driver pulley 31 and the frictionally driven driver pulley 41 is called the "nip"; this line of contact normally will be between and parallel to the axis of rotation of each pulley. Thus, the drive pulleys most preferably are formed of somewhat hard but elastomeric-type materials; but other materials known in the art may be used. Similarly, the breaking or severing rollers 32 and 42 are suitably formed of such material, since the causation of rotation for the roller 42 is satisfactorily accomplished through the frictional contact (i.e., the nip) of the roller 32 on it (and on the strip of tags passing between the two breaking or severing rollers). The strip of tags should be narrower than the lateral width of the drive and breaking pulleys.

The toothed master pulley 64 of relatively large diameter effectively causes the relatively smaller diameter toothed pulley 66 (which is mounted by its hub 68 on breaking shaft 70) to rotate faster than the driving pulleys 31 and 41 with each stroke of the piston rod 51 of the air cylinder. A toothed belt such as a timing belt 67 about the toothed master pulley 64 and the toothed breaking or severing shaft pulley 66 contributes to a positive relationship of rotation between those elements and such positive rotation relationship between those elements is greatly preferred for reliable operation of the apparatus.

To be noted with respect to FIG. 4 is that the breaking or severing roller 32 is carried fixedly on shaft 70 by mounting collars or hubs such as illustrated at 32*a.* Appropriate bearings 71 are also employed to facilitate easy rotation of shaft 70. The lower jaw elements are similarly carried on a shaft below the shaft 70.

Of significance is the actual breaking or separation of each marker tag from the tape of marking tags. Lines of weakness (as by scoring, perforation, lines of multiple miniature cuts, or any other technique to cause weakening) are a significant part of the tape of marking tags; and the distance between such lines of weakness should ideally be uniform throughout the length of a roll of the marking tag tape. In this connection, the distance between the nip of the driving rollers and the nip of the breaking rollers should be greater than the distance between the tape lines of weakness but less than twice the distance between the tape lines of weakness. More appropriately, the distance between the nip of the drivers and the nip of the breaking rollers should lie between about 105 and 195% of the distance between tape lines of weakness in order to successfully sever a single marking tag (at a line of weakness) from the rest of the tape without mutilating or stretching of the marking tag. More limited ranges at 5% increments (starting with the range between about 110% and 190%) are preferred. Empirically it appears that a distance between the nips of driver and breaking rollers at about 125% the distance between the lines of weakness gives ideal results.

Figure 5:
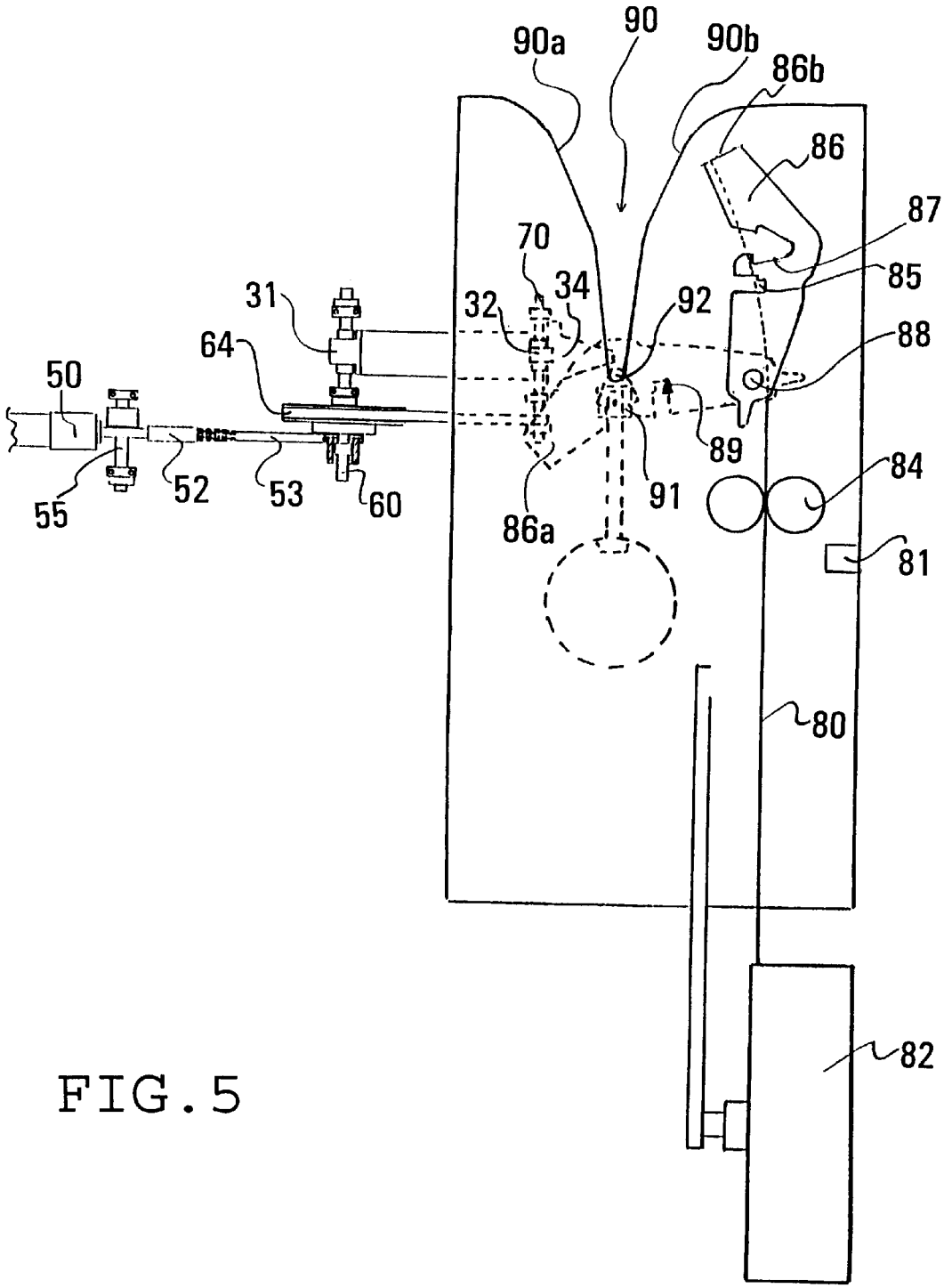
FIG. 5 is a schematic top plane view of the tag presenter apparatus of the invention in combination with a twist tie applicator, with foundational and frame apparatus elements mainly omitted.

Now, referring to FIG. 5, the orientation of the tag presenter will be discussed with respect to an illustrative twist tie applicator (e.g., formerly an American Packaging (of New Richmond, Wis.) "Super Mini Tier," now called "Super Tier" as marketed by Bedford Industries, Inc., the assignee of this application). Numerals below 80 in FIG. 5 refer to component portions or parts of the tag presenter, whereas numerals of 80 and above refer to elements of the twist tie applicator.

First it should be noted that twist tie ribbons have historically been formed by embedding deadfold wire in plastic strips by extrusion or by embedding deadfold wire between ribbons of materials of paper or plastic or paper plastic combinations. But in recent years, polymeric materials have permitted the formation of all-polymeric wireless twist tie ribbons. Thus "twist tie" as used herein embraces not only the widely known deadfold wire-type ribbons but also the all-polymeric ribbons. Another point to be observed is that twist tie ribbons are commonly wound on spools in a manner causing the ribbon to go back and forth from one edge to the other edge of the spool as it is being wound. Thus, extremely long lengths of twist tie ribbon can be carried for industrial purposes on very large spools.

The twist tie ribbon pulled from a large spool 82 (suitably mounted on a shaft extending from an arm off the main apparatus of a twist tie applicator) is drawn through a pair of feed rollers 84 into a packer arm 86 having a tying recess 87. The drawn ribbon is pushed through the packer arm past the cutter recess 85 and past the mouth of the recess 87 toward the far end 86*b* of the packer arm. A bag (of bread or any other merchandise) is inserted into the throat 90 and the converging edges 90*a* and 90*b* of the throat assist in pulling the mouth portions of the bag toward each other so as to collapse them into a neck for application of a twist tie. Significantly, packing arm 86 then rotates at a pivot mounting 88 so as to place the packing arm into the position 86*a,* with the tying recess 87 embracing the bag neck; and this action further collapses the mouth of the bag into a neck of small circular area labeled 92 in FIG. 5. The rotation of the packing arm wraps the twist tie ribbon (at tying recess 87) around the bag neck to a certain extent and simultaneously as this takes place, the movement of the packer arm hits a knife 89 which cutter recess 85 moves over (as the pivot of the packer arm takes place about pivot mounting 88). As a consequence, the tie ribbon is not only entrained about the neck of the bag by the packer arm but also is cut to an appropriate length to form a tie about the neck. This action severs the portion to form the tie from the resource or supply length 80.

A tag from the tag presenter has, prior to this action, been placed (i.e., presented) in the circular area 92 of the throat 90 in a condition of readiness to be bundled or tied to the bag by the twist tie ribbon. Thus, the action of the packer arm in pivoting to the position 86*a* in FIG. 5 not only completes the gathering of all parts of the bag into a bundle or neck at the mouth end of the bag but also fixedly grabs the tag presented by the tag presenter through the nozzle element 34 of the tag presenter. Once this status of machine operation is reached (i.e., with the packer arm in position 86*a*), a twist tie head 91 (shown only crudely) rotates to twist the twist tie ribbon around the bag and the tag as presented by the tag presenter. The geometry of the packer arm itself serves to bring the twist tie ribbon into contact with the tines of the twist tie head, which whirl and twist the ribbon into a tied condition about the neck area of the bag as well as the tag. As soon as the twist tie ribbon has been twisted by the twist head, the packer arm swings back to its original position (shown in solid lines); and the bag which has been closed with a twist tie embracing its neck and embracing the marking tag at its neck is removed from the tying machine. All of this is suitably done automatically, and the procedure is rather well known. The last thing in this cycle that the tying machine does is advance the twist tie ribbon 80 into the packer arm 86 for tying the next bag. At the end of this operation, before the packer arm moves for tying action, the tag presenter operates to present another tag in the proper position within the area 92 of FIG. 5 to be attached by tying to the next bag.

Figure 6:
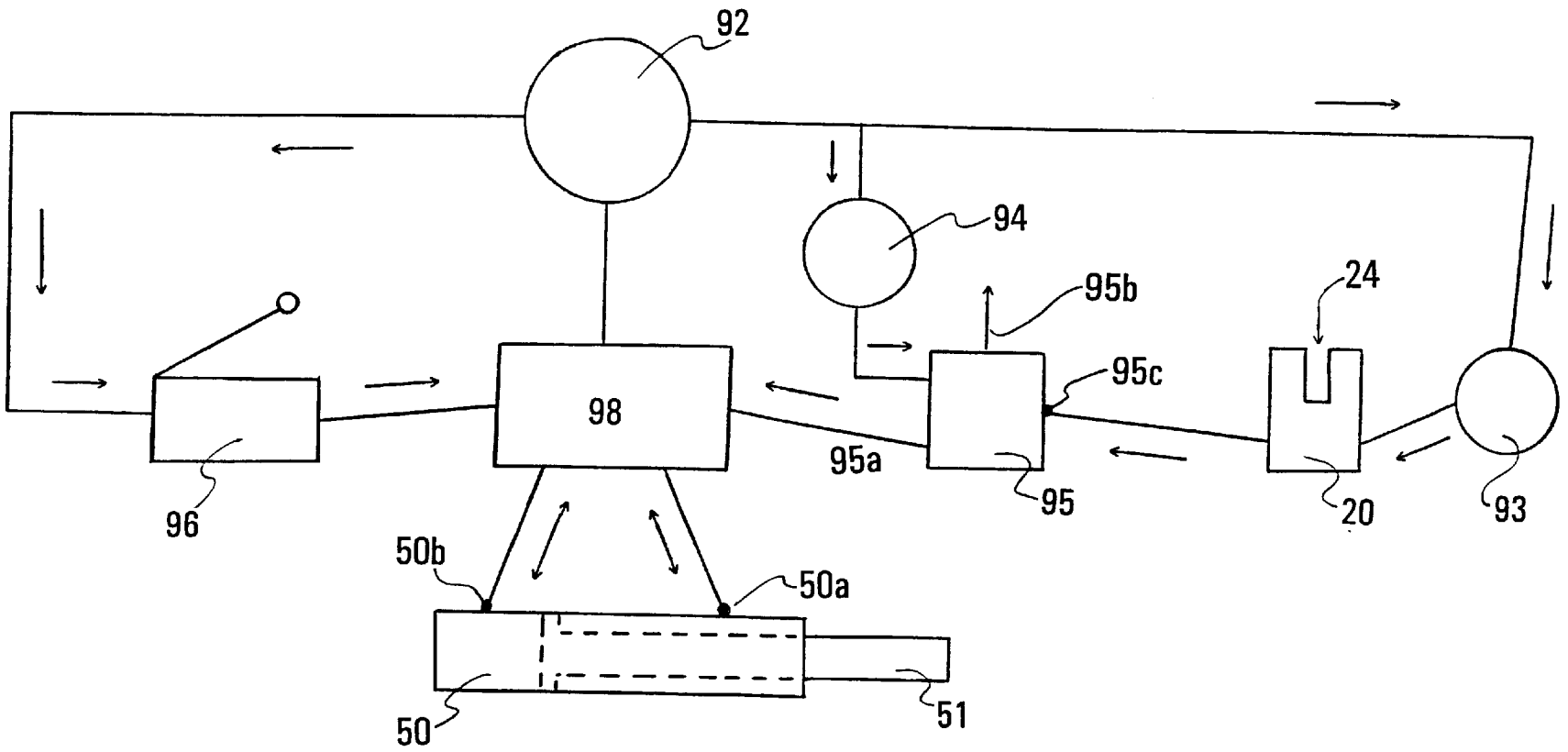
FIG. 6 is a schematic diagram of control elements for operation of the apparatus taught herein.

Next to be discussed is the logic system of FIG. 6.

The new system is reliably operated on the basis of air (e.g., hydraulic) motive power, and this is schematically illustrated in FIG. 6. An air supply, suitably under an air pressure of about 60 psi gauge, feeds air through several lines of the control system. Air from source 92 passes to a pressure regulator 93 to reduce the air pressure down to about 5 psig for operation of the sensor 20. An illustrative useful sensor is Miniature Gap Sensor Model 1030 of the Clippard Instrument Laboratory, Inc. of Cincinnati, Ohio. This sensor, known as the 1030 Gap Sensor, sends out a negative signal so long as an object passing through its gap 24 is sensed; but when a neck of the tape of tags passes the gap, the neck itself is not sensed (i.e., is not detected as an obstruction), and instead the sensor detects a lack of object in the gap, which in turn causes a positive signal to be sent from the sensor. When the positive signal is transmitted, air of low pressure passes to the magnifier 95, which illustratively is a snap action relay, suitably Model 3200-A from the Clippard Instrument Laboratory, Inc. of Cincinnati, Ohio. The magnifier relay is powered from a source of air from the air supply that has been passed through a pressure regulator 94 to reduce the air pressure to about 45 psig. Air entering the magnifier relay 95 from the pressure regulator 94 creates (under normal conditions) a slightly negative air flow into the relay 95 from line 95*a* because, so long as the sensor 20 sends out a negative signal, no real burst of air from it to the relay 95 takes place, and the air entering the relay 95 from the air source 92 will exit through an exhaust 95*b*. But once the sensor 20 sends out a positive signal indicating that nothing is in the gap at the locus of the sensing function of the gap (i.e., a neck of a tag of the tape of tag is present), a burst of low-pressure air passes from the sensor 20 to the relay 95, and this burst causes a blockage of air flow out the exhaust 95*b* and a resultant burst of air (at rather substantial pressure approaching 45 psig) to pass to a four-way valve 98.

To review the immediate foregoing, when there is no signal at the control signal port 95*c* of the relay 95 (i.e., when no air is rushed from the sensor 20 to the relay 95 during times when the sensor perceives the presence of a body of tape passing in its gap), the supply pressure to the relay from the pressure regulator 94 creates a slight vacuum or negative pressure at the outlet port of the line 95*a* to the four-way valve 98. But when there is signal pressure at the control signal port 95*c* from the sensor 20 to the relay 95, the diaphragm within the relay 95 reflects and blocks a small channel in the sliding mechanism in the center of the relay 95, which in turn causes all the supply air from the regulator 94 to be redirected to the outlet port of the relay 95 and passed over line 95*a* to the four-way valve. It is when there is a signal pressure coming in from the sensor 20 that the relay 95 operates to magnify the pressure of air (i.e., by using air entering from regulator 94) from the relay to the four-way valve 98.

The four-way valve 98 operates to pass air through conduits to the pneumatic cylinder 50 in which a piston is located and operates the piston rod 51 to cause a tag to be presented for tying attachment to a bag or the like.

The operation of this pneumatic circuit now will be summarized as follows:

1. Start switch 96 (suitably located on the Super Tier) is activated (i.e., opened to pass air) at the end of the cycle of action of the power source 81 (e.g., air cylinder) that advances tie ribbon in the packer arm. This switch is closed at the beginning of the next complete tying/bagging cycle, i.e., at the beginning of the motion of the power source 81 (air cylinder) causing advancement of tie ribbon into the packer arm 86.

2. Start switch 96 allows a pressure signal to travel to the four-way valve 98. This signal shifts a spool inside the four-way valve. The shifting of the spool allows air to flow from the four-way valve's input to the right port 50*a* on the tag applicator air cylinder 50. This flow begins to retract the piston rod 51, which begins the movement of tag presenter drive and break rollers.
3. The piston rod 51 continues to move until the correct amount of tag has been advanced. At this time the sensor 20 "sees" nothing (i.e., "sees" the narrow neck of the tag). The sensor then sends a very weak pressure signal to the relay 95.
4. The function of the relay 95 is to amplify the weak signal from the sensor 20. The signal must be amplified in order to switch the spool in the four-way valve.
5. Once the spool in the four-way valve is shifted by air from relay 95, the valve's supply air can flow into the other (left) port 50*b* of the air cylinder 50. This returns the piston rod 51 to its extended position (i.e., ready for another cycle).

Apparatus of the invention is useful for intermittently presenting tags in a posture for attachment to merchandise moving intermittently along a conveyor line, and includes a pay-out tape of tags severable from the tape by lines of weakness extending laterally at intermittent spacing along the length of the tape, drive rollers intermittently activated to advance the tape from the payout roll in response to sensing when a previously advanced tag has been already attached to merchandise, breaking rollers intermittently activated to rotate at a greater speed than the drive rollers to thereby sever a single tag from the advancing tape at a line of weakness, and guide members on opposing sides of the severed tag for presenting the tag at the exit between the opposing guide members.

An overall summary of the occurrences in twist tie attachment of marking tags to merchandise according to the invention is now offered:

1. An open bag filled with product arrives on a conveyor and is laterally shifted so that the bag neck is inserted into the throat of Super Tier, where a marking tag is held in readiness to be attached to the bag neck by a twist tie. As the bag neck is inserted into the throat, a lever on the Super Tier is moved and triggers or initiates the tie ribbon tying cycle.
2. As the first step in tying, pack arm 86 pivots from its position shown in solid line in FIG. 5 to its position of dashed lines, and this simultaneously causes the tie ribbon extending across its tying recess 87 to wrap about the bag neck as well as the portion of the marking tag held in readiness for attachment to the neck of the bag.
3. The tie ribbon is cut as the pack arm finishes its rotational pivot about the pivot mounting 88.
4. Also, as the pack arm finishes its rotational pivot, the tines of the twist tie head 91 spin and twist the cut tie ribbon length securely around the neck of the bag. This action also secures the marking tag between the twist tie ribbon and the bag neck—thus forming a twist tie closed and tagged product.
5. The pack arm 86 then pivots back to its initial solid line position.
6. Twist tie ribbon is then automatically advanced into the packer arm.
7. Once the twist tie ribbon has been advanced (i.e., at the end of the cycle of operation of power source 81) into the packer arm, the tag presenter begins its cycle. At the same time the bag that has been tagged and closed by a twist tie is removed from the throat of the Super Tier. The tag presenter cycle is initiated via the opening of an air switch 96 located on the Super Tier; and this is caused by the advancement of the twist tie ribbon. This switch remains open until the next complete tying/tagging cycle is started.
8. The opening of switch 96 allows air to flow through valve 98 and into the air cylinder 50. This retracts the cylinder rod 51 which causes chain 53 to move laterally left as viewed in FIG. 3.
9. The movement of chain 53 causes sprocket 57 to rotate counterclockwise as viewed in FIG. 3. This rotation is transferred to shaft 60 through a one way clutch 59.
10. The counterclockwise rotation of shaft 60 causes the tag material to be drawn to the right in FIG. 3 via the rollers 31 and 41. The tag material comes from a payout roll as shown in FIG. 1.
11. The tag material is advanced by drive rollers 31 and 41 to make contact with the smaller breaking rollers 32 and 42. These breaking rollers are rotated faster than rollers 31 and 41 through the pulleys 64 and 68 and the timing belt 67.
12. Upon contact with the breaking rollers, a tag is broken along a line of weakness. The separated tag continues to be advanced by the breaking rollers until it is completely free of the breaking rollers. At this time a tag is presented and held between guides 34 and 44 for the next bag that has been tied.
13. The rotation of the drive and breaking rollers is stopped by the operation of sensor 20. The sensor is activated by the sensing of the narrow neck on a section of the tag material.
14. When the sensor 20 is activated, it sends a low pressure air signal (about 5 psig) to a snap action relay 95. This relay acts to amplify the signal from sensor 20 so as to be strong enough to shift the valve 98. The relay 95 has a regulated air source from regulator 94. This air source is of sufficient pressure (45 psig) to shift the spool in valve 98.
15. Upon the shifting of valve 98, the air flow into the cylinder 50 is reversed. This causes the cylinder rod 51 to extend. As the cylinder rod extends, the chain 53 is moved like before, but it is now moved to the right when viewed in FIG. 3. The sprocket 57 rotates clockwise from the motion of chain 53. Shaft 60, however, does not rotate because the one way clutch that connects shaft 60 and sprocket 57 spins freely in the clockwise direction (as viewed in FIG. 3). The cylinder rod 51 continues to advance until it reaches the end of its stroke.
16. During the operation of the tag presenter, the machine operator has placed the tagged bag onto another conveyor that moves the bag into another area for shipping etc.

Those skilled in the art will readily recognize that this invention may be embodied in still other specific forms than illustrated without departing from the spirit or essential characteristics of it. The illustrated embodiments are therefore to be considered in all respects illustrative and not restrictive.

That which is claimed is:

1. Apparatus for intermittently presenting tags in a posture for attachment to merchandise, comprising a pay-out tape of tags severable from the tape by lines of weakness extending laterally at spaced intervals along the length of the tape, drive rollers intermittently activated to advance tape from the pay-out roll, breaking rollers that receive tape advanced by said drive rollers and that rotate when said drive rollers are rotated and that rotate at a greater speed than said drive rollers, thereby to sever a single tag from the advancing tape at a line of weakness, and a curved path for receiving said severed single tag as it is advanced by said breaking rollers, said curved path being formed by curved opposing holding guide members on opposite sides of the severed single tag for presenting a leading portion of said tag in a position exterior to said curved path for attachment to merchandise by a twist tie while temporarily holding the remaining portion of said severed single tag within said curved path between said opposing guide members in a manner for easy removal therefrom.

2. The apparatus of claim 1 wherein said drive rollers and said breaking rollers are driven by a common source.

3. The apparatus of claim 1 wherein each tag in said pay-out tape of tags comprises a lead section, a neck section and a body section in sequential alignment, and wherein said lead section and said neck section of a severed single tag constitute said leading portion of said severed single tag not temporarily held between said opposing guide members in a manner for easy removal therefrom.

4. The apparatus of claim 1 wherein the leading portion of said severed single tag projects in an upward direction from the curved path formed by said holding guide members.

5. The apparatus of claim 1 wherein the spaced intervals for the lines of weakness in said tape are uniform throughout said payout tape of tags and thereby delimit tags having uniform length.

6. The apparatus of claim 5 wherein said drive rollers are aligned to form a driving nip through which said pay-out tape of tags is passed and said breaking rollers are aligned to form a breaking nip for severing single tags from said pay-out tape of tags, and wherein the distance between said driving nip and said breaking nip is greater than said length of said tags and less than twice said length of said tags.

7. The apparatus of claim 1 in combination with a tying machine having a merchandise receiving recess for receiving the neck of a bag to be tied by a twist tie, said merchandise receiving recess being in proximate relationship to said holding guide members so that said leading portion of said severed single tag for attachment to merchandise by a twist tie is presented in said merchandise receiving recess.

8. The apparatus of claim 7 wherein said holding guide members are beneath said merchandise receiving recess and cause the leading portion of said severed single tag to project upwardly into said merchandise receiving recess.

9. The combination of claim 7 wherein said merchandise receiving recess comprises a guide slot for forming said bag neck.

10. The combination of claim 9 additionally including a pivotable packer arm for moving twist tie ribbon into a position for embracing said bag neck as well as the leading portion of said severed single tag not held by said holding guide members.

11. The combination of claim 10 additionally including a twist tie head for twisting twist tie ribbon about said bag neck as well as said leading portion of said severed single tag at the same time.

* * * * *